United States Patent [19]

Peschl

[11] 4,408,889

[45] Oct. 11, 1983

[54] UNIVERSAL BLENDING SILO

[76] Inventor: Ivan A. S. Z. Peschl, Kennedylaan 8, 6029 RE Sterksel, Netherlands

[21] Appl. No.: 304,208

[22] Filed: Sep. 21, 1981

Related U.S. Application Data

[62] Division of Ser. No. 99,038, Nov. 30, 1979, Pat. No. 4,345,842.

[51] Int. Cl.[3] ..... B01F 5/00; B01F 5/10; B01F 5/26; B01F 15/02

[52] U.S. Cl. ..... 366/113; 222/199; 222/200; 366/114; 366/116; 366/137; 366/341; 414/288; 414/304

[58] Field of Search ..... 366/113, 116, 118, 119, 366/136, 137, 154, 159, 182, 184, 191, 194–196, 276–278, 341; 222/196, 198, 199, 200; 414/288, 304

[56] References Cited

U.S. PATENT DOCUMENTS 3,773,231 11/1973 Wahl ..... 222/199
3,973,703 8/1976 Peschl ..... 222/199

*Primary Examiner*—Timothy F. Simone

*Attorney, Agent, or Firm*—Hubbell, Cohen, Stiefel & Gross

[57] ABSTRACT

The present invention is a universal blending system and method for blending the material contents of a silo having a predetermined interior cross-sectional area by layer blending or across vertical columns, column blending, or a combination of layer and column blending.

The presently preferred method of the present invention employs either vertical displacement of a partial vertical column of the silo content to provide a representative mixture in every horizontal cross-section in order to reduce the number of necessary recycles to a minimum or substantially simultaneous multilevel displacement, with subsequent uniform discharge over the whole horizontal cross-section of the silo to remix material that may have been segregated during the filling or recycling. In either event, the presently preferred universal blending system includes a blending bottom whose construction gives the opportunity to make a choice of (1) discharge over only a partial area of the outlet area; (2) uniform discharge over the whole outlet area; or (3) predictable discharge velocity distribution over the outlet area.

28 Claims, 36 Drawing Figures

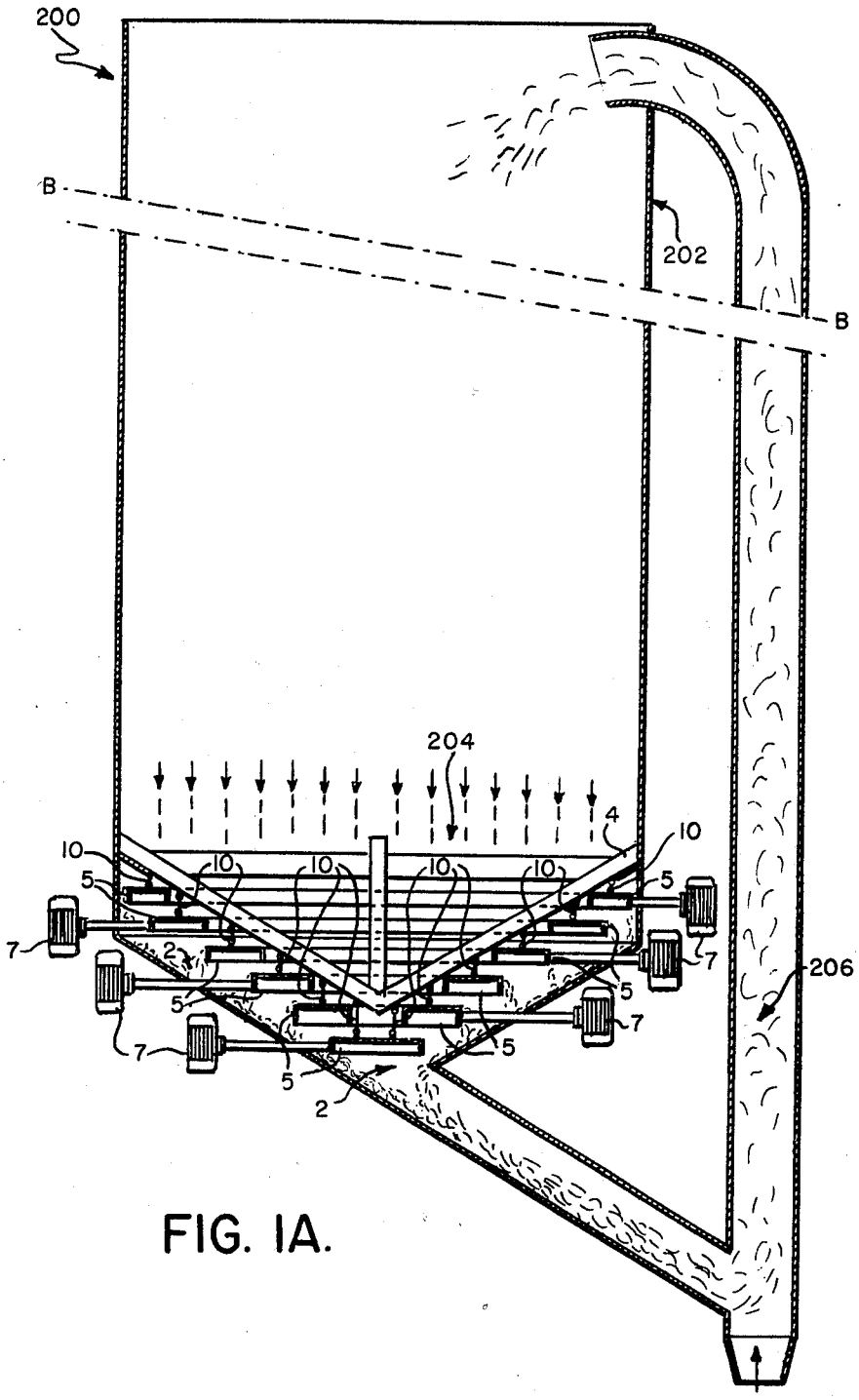
FIG. IA.

BLENDING PROCEDURE I

FIG. 16A. FILLING

FIG. 16 B. EMPTYING

BLENDING PROCEDURE 2

FILLING
B
A

PARTIAL RECYCLING
B
A
B
B
A
A

STOP RECYCLING
B
A
B
B
A
A

EMPTYING
B
A
B
A
B
A
A+B

BLENDING PROCEDURE 2a

BLENDING PROCEDURE 3

BLENDING PROCEDURE 4

UNIVERSAL BLENDING SILO

This application is a divisional patent application of U.S. Patent application Ser. No. 099,038 filed on Nov. 30, 1979, U.S. Pat. No. 4,345,842.

CROSS-REFERENCE TO RELATED APPLICATIONS

This application is related to my previously issued U.S. Pat. No. 3,973,703, entitled "Device For Discharging Powdery Or Granular Material".

BACKGROUND OF THE INVENTION

1. Field of the Invention

The present invention relates to blending methods and systems for powdery or granular material and particularly to a universal blending method and system for such material.

2. Description of the Prior Art

Prior art blending systems and methods known to applicant are not truly universal in that they do not readily accommodate different size particles and different composition materials in an efficient manner and, thus, require inefficient multiple recyclings of the materials being blended to achieve a proper blending mixture. This is inefficient both in terms of cost and in terms of time and, moreover, is an inefficient use of energy whose loss may be considerable depending on the size of the silo involved and the quantity of material to be mixed. As will be explained hereinafter, the universal blending silo of the present invention overcomes these disadvantages and is capable of handling a large variety of materials ranging from free flowing to very cohesive; is capable of blending layered as well as column segregated materials; does not impose any meaningful limitations on the height or diameter of the silo to be employed; enables the silo to be adjusted to meet a large range of blending requirements; enables adjustment of the vertical velocity profile over the cross-section of the silo which enhances the blending; and substantially reduces the number of recycle blending runs which, in some instances, can be reduced to less than one.

SUMMARY OF THE INVENTION

The present invention is a universal blending system and method for blending the material contents of a silo having a predetermined interior cross-sectional area by layer blending or across vertical columns, column blending, or a combination of layer and column blending.

The presently preferred method of the present invention employs either vertical displacement of a partial vertical column of the silo content to provide a representative mixture in every horizontal cross-section in order to reduce the number of necessary recycles to a minimum or substantially simultaneous multilevel displacement, with subsequent uniform discharge over the whole horizontal cross-section of the silo to remix material that may have been segregated during the filling or recycling. In either event, the presently preferred universal blending system includes a blending bottom whose construction gives the opportunity to make a choice of (1) discharge over only a partial area of the outlet area; (2) uniform discharge over the whole outlet area; or (3) predictable discharge velocity distribution over the outlet area.

One aspect of the present invention relates to a blending method employing vertical displacement of one or more predetermined partial vertical columns of the silo content, consisting of a number of layers of different or slightly different material, to provide the representative mixture in every horizontal cross-section prior to uniform discharge over the whole outlet area. In this regard, the presently preferred blending method comprises lowering of a partial vertical column of the silo content of the initial upper level into the initial lower lever and simultaneously replacing an equal amount of material from the lower level into the upper level. Using the effect of core-flow or pipe-flow characteristics the partial column of material is lowered without substantially disturbing the adjacent material around the displaced partial column. Lowering of the partial vertical column and recycling of the material to the upper section is continued until a checkered pattern is obtained in a vertical cross-section, and the average composition of the material at each horizontal cross-section is representative of the composition of the entire silo content. Through the above mentioned effect of core-flow, the material which is moved by a recycling installation from the initial lower section will occupy the vacated space in the initial upper section directly above the vertical column.

For a simple layer pattern the first blending step is the displacement of the partial vertical column and simultaneously recycling in the upper section. This step will continue until a checkered pattern is obtained in a vertical cross-section and the average composition of the material of each horizontal cross-section is representative of the composition of the entire silo content. However, in different places in a cross-section of the silo, as following a checkered pattern, there are materials of different qualities. A final homogenization is achieved in the collection hopper during the discharge operation where discrete quantities of the material, discharged from different radial positions of the blending bottom and having different qualities, fall over each other during the sliding of the inclined walls of the collection hopper in the direction of the hopper outlet where the material from all areas of the collection hopper will be collected. This procedure enables blending to occur with a number of recycles less than one. For two layer blending the absolute minimum of recycling of $\frac{1}{4}$ of the silo content is sufficient to reach a blending with the method of the present invention. For more complicated multilayered silo content, a combination of the displacement of one or more vertical columns with subsequent recirculation with a predicted velocity distribution over the horizontal cross-area of the silo is recommended, in accordance with the present invention, to reach, according to a given composition of layers, an absolute minimum of necessary recycles.

The aforementioned step of displacing of one or more vertical columns is used as a pre-blending with subsequent recyclings for final blending of the silo content. In accordance with the present invention, the necessary number of recycles will be a minimum if the velocity distribution over the cross-area of the silo is chosen according to the given pattern with the chosen velocity distribution being reached by adjusting different rates of discharge on different areas of the blending bottom. The third step is the discharge of the blended material. There we have two opportunities. In the case of the material segregating, an adjustment of the blending bottom for uniform velocity distribution is necessary to reach the remixing of segregated components as was previously described with respect to the discharge operation of the checkered pattern. In the case of the material not segregating, the non-uniform velocity distribution which is used for recycling can be used for this discharge operation also. Using this preferred blending procedure the number of recycles can be reduced to less than two. For extremely complicated blending properties and in extremely high silos, blending ducts with inlet ports at various heights may help maintain the introduced velocity profile by the blending bottom and accelerate the blending process by multilevel discharge of the material from the various layers.

It should be noted that for some compositions of layers the minimum number of necessary recycles may be reached by using the optimal velocity distribution during the recycling without displacement of the partial vertical columns. It should also be noted that a blending silo can have more than one blending bottom and more than one partial vertical column can be simultaneously recycled where the blending of this partial column has already occurred. The discharge or displacement of the partial vertical column is achieved by simultaneously discharging, recycling and replacing the material into the vacated area of the vertically displaced partial column. After achieving the checkered pattern in vertical and horizontal cross-section, meaning that a representative mixture is reached within the horizontal cross-section, final homogenization of the checkered pattern of the horizontal cross-section will be achieved through uniform discharge across the whole outlet area in the collection hopper.

BRIEF DESCRIPTION OF DRAWINGS

FIG. 1A is a partial schematic sectional view of the interior of a universal blending silo in accordance with the present invention;

DETAILED DESCRIPTION OF PREFERRED EMBODIMENTS

Figure 1B:
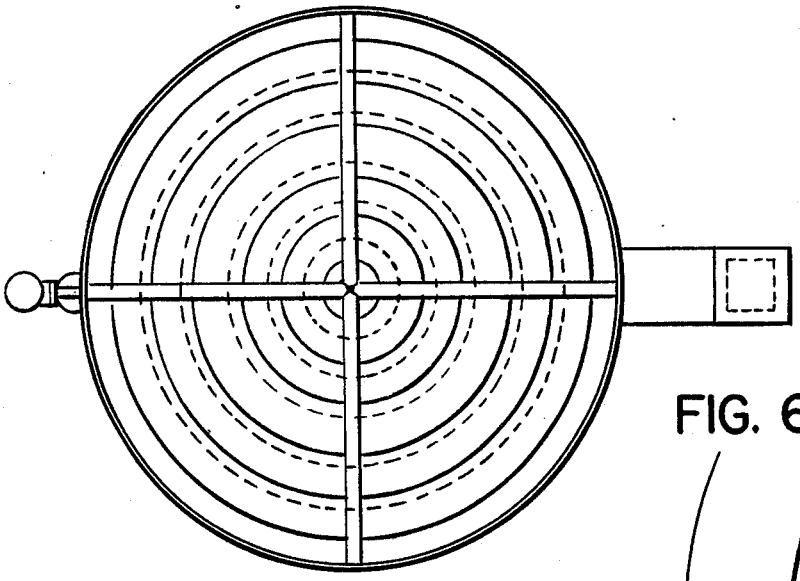
FIG. 1B is a cross-sectional view taken along line B—B in FIG. 1A.
Figure 6:
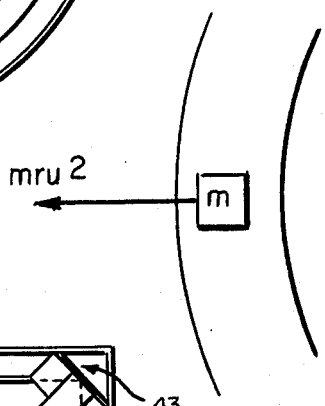
FIG. 6 is a diagrammatic illustration of the vibratory effect for discharging material in accordance with the method of the present invention.
Figure 2B:
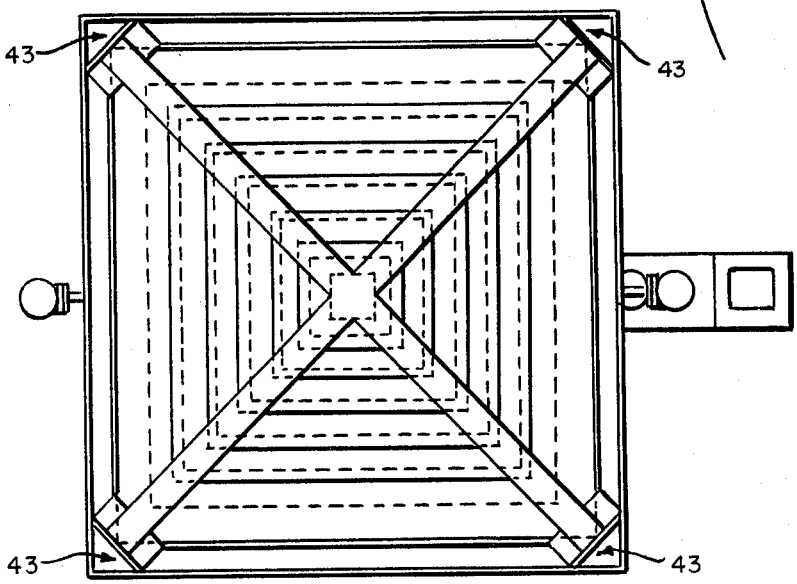
FIG. 2B is a cross-sectional view similar to FIG. 1B taken along line B—B in FIG. 2A.
Figure 1C:
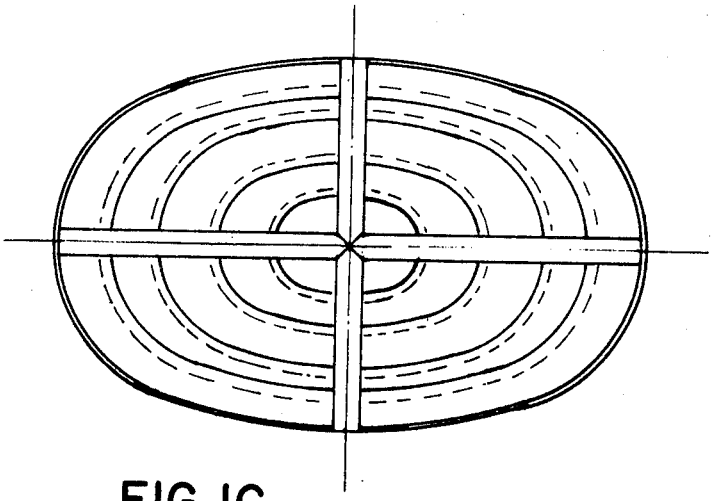
FIG. 1C is a cross-sectional view taken along the line B—B in FIG. 1A wherein the cross-section of the silo and/or blending bottom is elliptic.
Figure 2A:
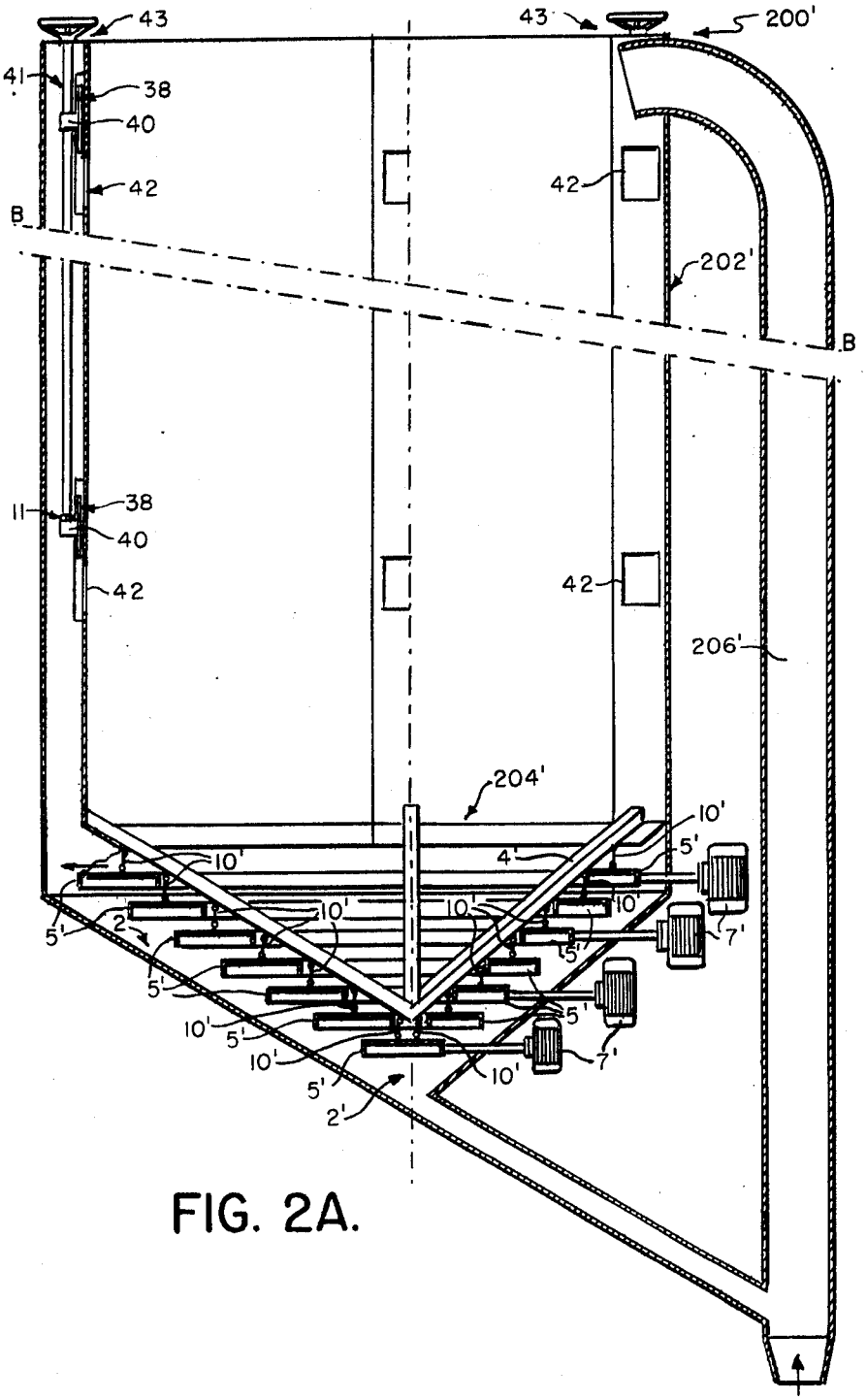
FIG. 2A is a partial schematic sectional view similar to FIG. 1A of the interior of an alternative embodiment of the universal blending silo of FIG. 1A.

Referring now to the drawings in detail, and initially to FIGS. 1 and 2 thereof, the presently preferred overall design of the universal blending silo 200, 200' of the present invention is illustrated in FIGS. 1A and 1B with respect to blending silo 200 and in FIGS. 2A and 2B with respect to blending silo 200'. As will be described in greater detail hereinafter, universal blending silo 200' is useable in accordance with the method illustrated in FIG. 20 as well as with the method illustrated in FIGS. 16–19. As shown and preferred in FIGS. 1A and 2A the universal blending silo 200, 200' preferably includes the silo container itself 202, 202', respectively, blending channels with inlet ports along the silo wall, such as blending ducts 43 illustrated in FIG. 2A having inlets 42, a blending bottom 204, 204', a collection hopper 2, 2', and conventional equipment for recycling (not shown) including recycling duct 206, 206'. The blending bottom 204, 204', preferably connected at the bottom of the silo, preferably comprises a plurality of concentric rings 5, 5' of decreasing diameter that are attached to a support frame 4, 4' by means of hinged connectors 10, 10' illustrated in greater detail in FIG. 3. As shown and preferred in FIG. 3, the vertical distance between adjacent pairs of blending rings 5 can be varied by means of adjustable bolts 11. As also shown and preferred in FIG. 3 a conventional vibrator 7, such as an electromagnetic or unbalanced vibrator, which can be mounted outside or inside the collection hopper 2, is connected to the blending ring 5 by means of a support 8. The vibrator 7 preferably transmits the oscillating movement into the blending ring 5 that in turn moves the granular or powdery material above it with centrifugal forces, such as diagrammatically illustrated in FIG. 6, in a radial direction towards the interior wall of the collection hopper 2 in accordance with the resultant transport velocity which is dependent on the expression $mr\omega^2$, where m represents the mass of the particle, r represents the amplitude of oscillation and $\omega$ represents the frequency of the vibrator 7.

Figure 3:
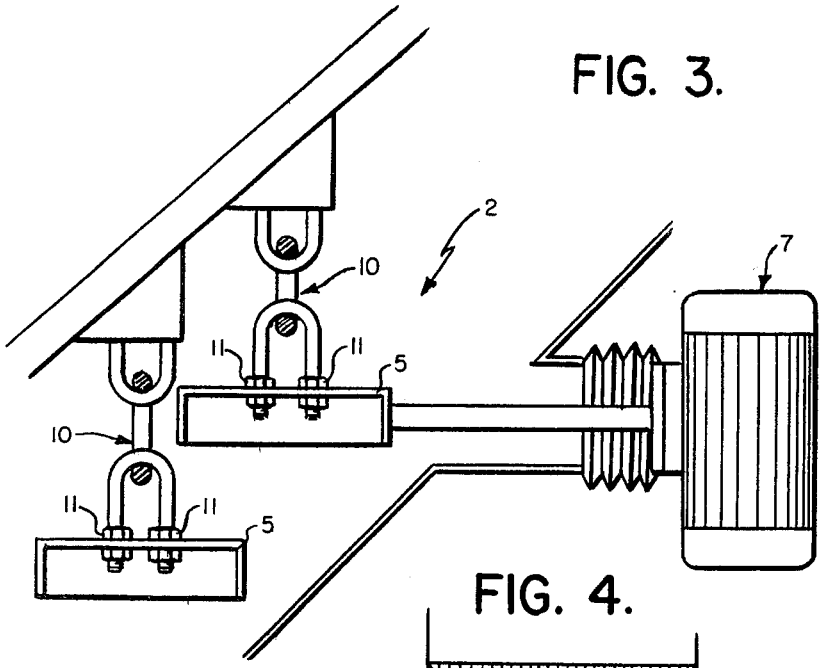
FIG. 3 is a fragmentary enlarged schematic sectional view of a portion of the blending bottom of the silo of FIGS. 1A and 2A illustrating a hinged connector.
Figure 4:
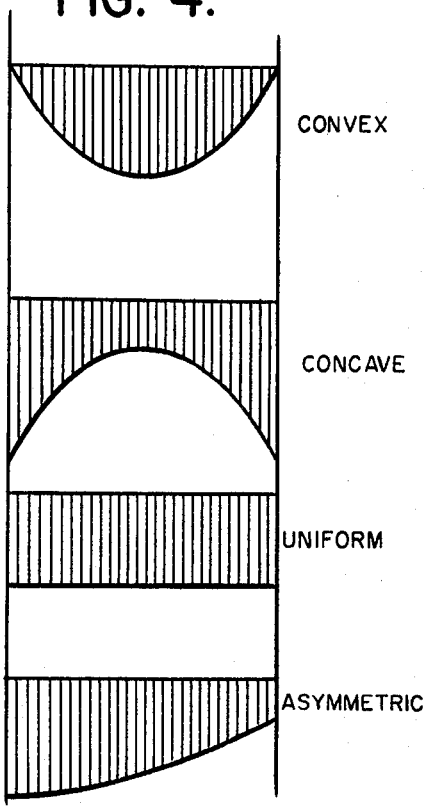
FIG. 4 is a diagrammatic illustration of typical examples of velocity profiles in accordance with the present invention.
Figure 5A:
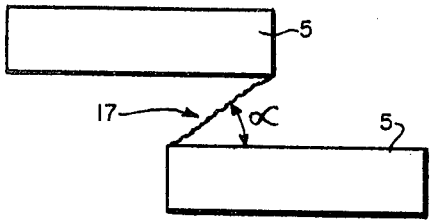
FIGS. 5A and 5B are diagrammatic illustrations illustrative of the presently preferred method of the present invention illustrating the natural angle of repose in FIG. 5A at which material flow is stopped and illustrating bridging in FIG. 5B at which material flow is stopped.
Figure 5B:
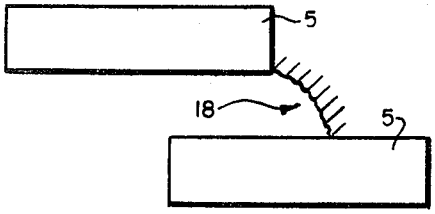

As is further shown and preferred in FIG. 3 as well as in FIGS. 1A and 2A, a slot or opening is provided between a pair of adjacent rings 5 with the discharge rate which is controlled being, in effect, the discharge rate through the slot between the rings 5. As shown and preferred in FIGS. 5A and 5B and further shown in FIGS. 14A and 14B, the flow of material is stopped either by the natural angle of repose of the material for large particles or by bridging (FIG. 5B) of the material for finer particles, with this bridging or natural angle of repose of the material being disturbed by vibration due to the vibrator which leads to a predictable rate of flow of material such as illustrated in FIG. 14B by adjustment of the amplitude or frequency of the vibrator.

Figure 14A:
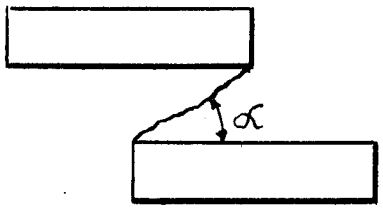
FIGS. 14A and 14B are diagrammatic illustrations similar to FIG. 5A illustrating the method of disturbing the natural angle of repose of the material in accordance with the method of the present invention.
Figure 14B:
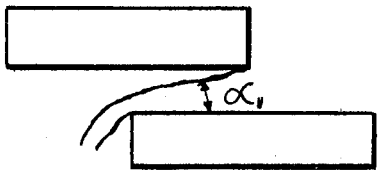
Figure 16:
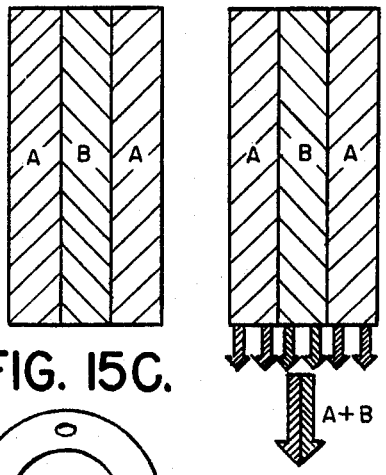
FIGS. 16A and 16B are diagrammatic illustrations of a blending procedure in accordance with the method of the present invention.

Thus, the discharge rate through the slot between adjacent rings 5 is controlled on one hand by adjusting the distance between the rings 5 and on the other hand by the amplitude and frequency of the vibrator 7 as well as also being controlled by utilizing the property of the natural angle of repose of the material being disturbed during vibration, such as illustrated in FIG. 14B. Preferably, the spacing or distance between adjacent rings 5 is such that at their steady state condition which is during shutdown of the vibrators 7, no discharge occurs due to the slot being blocked by the natural angle of repose 17 (FIGS. 5A, 14A) of the material or bridging 18 (FIG. 5B) of the material between two adjacent blending rings 5. Thus, by using various combinations of vibrator 7 connections and ring 5 design the discharge rate profile can be varied and selected by the user for optimal blending. In this regard, it should be noted that, preferably, the blending rings 5 may be driven individually by separate vibrators 7, 7' such as illustrated in FIGS. 1A and 2A, respectively, or as a rigid assembly of a plurality of blending rings 5 driven by a single common vibrator 7'' such as illustrated in FIGS. 8–12.

Figure 2C:
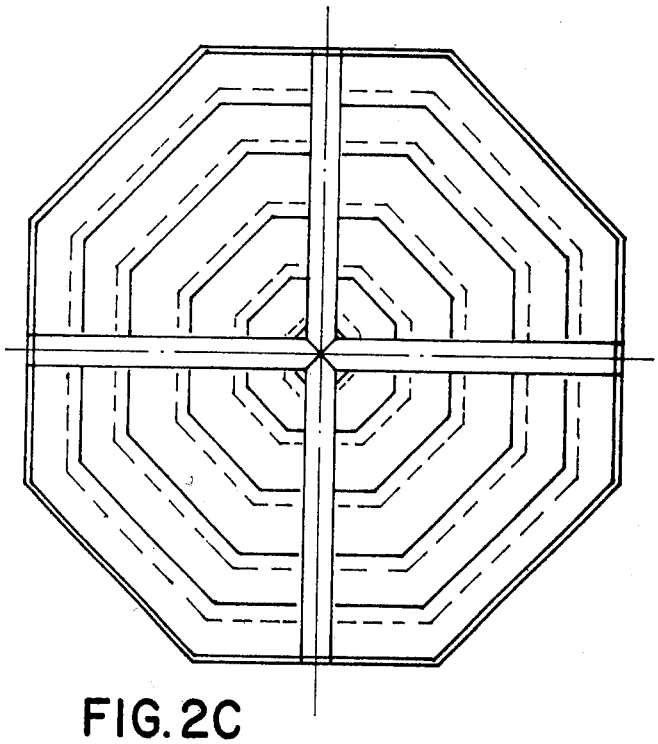
FIG. 2C is a cross-sectional view taken along the line B—B in FIG. 2A wherein the cross-section of the silo and/or blending bottom is polygonal.

The cross-section of the silo and the blending bottom including the blending rings can be either circular as shown in FIG. 1B, elliptical as shown in FIG. 1C, square or rectangular as shown in FIG. 2B, or polygonal in shape in cross-sectional shape as shown in FIG. 2C.

Figures 15A, 15B, 15C:
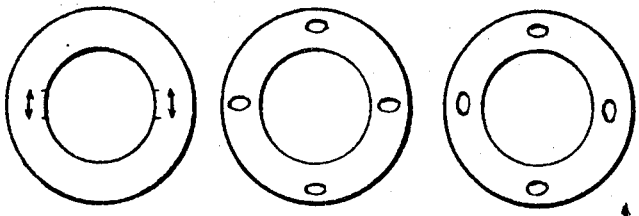
FIGS. 15A–15D are diagrammatic illustrations representative of the possible directions of oscillating movement of the blending ring in accordance with the method of the present invention.
Figure 15D:
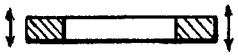

Referring now to FIGS. 15A–15D as well as FIGS. 1A and 2A, the blending bottom 204, 204' preferably comprises the vibrator 7, 7' and blending rings 5, 5' with the vibrator 7, 7' being attached to the blending rings 5, 5' in such a manner so as to move the associated rings 5, 5' in a specified direction. In this regard, the direction of movement of the blending rings 5, 5' can preferably be controlled by the positioning of the vibrator 7, 7' with respect to the corresponding blending rings 5, 5'. By accomplishing such positioning, various directions of oscillating movement can be achieved such as a translational oscillating movement within the plane of the blending ring 5; a translational oscillating movement perpendicular to the plane of the blending ring 5 such as illustrated in FIG. 15D; a rotational oscillating movement within the plane of the blending ring 5; a rotational oscillating movement perpendicular to the plane of the blending ring 5 such as illustrated in FIG. 15A; or a combination of the aforementioned directions of movement such as illustrated in FIGS. 15B and 15C, respectively. It should be noted that the axis of rotational movement or the direction of translational and rotational movement does not necessarily coincide with an axis of symmetry of the blending ring 5.

Referring again to FIGS. 2A and 2B, these figures illustrate a square universal blending silo configuration as opposed to the cylindrical blending silo configuration illustrated in FIGS. 1A and 1B. As was previously mentioned, in the arrangement shown in FIGS. 2A and 2B, blending is carried out by means of a plurality of blending ducts 43 that are preferably mounted along the outside wall of the silo 202' preferably at the corners of polygonal silos such as the square silo 202' of FIGS. 2A and 2B. Preferably, the blending ducts 43 have a plurality of inlets 42 located at various heights along the silo wall which permit material to enter into the blending ducts 43 with this material thereafter falling through the blending ducts 43 into the collection hopper 2' thereby bypassing a plurality of layers of different composition and properties. As shown and preferred in FIG. 2A, the entry of material into the blending ducts 43 is controlled by inlet shutters 38 that can preferably be adjusted individually or per channel by means of guide 40 and lever 41. In this manner the number of required recyclings for an acceptable quality of blending can be reduced, as will be explained in greater detail hereinafter with reference to FIG. 20. Thus, the shutters 38 are preferably opened and closed by means of the central guide 41 with the free space of each inlet 42 preferably being adjusted for each shutter 38 individually by means of adjustment nuts 11, such as illustrated in FIG. 2A. If extreme variations of material properties and composition occur, an acceptable quality of blending may not be achieved in a single run, in which instance the silo content must be recycled. This may be accomplished by means of conventional recycling equipment such as a conventional pneumatic or mechanical conveyor (not shown) which moves the material from the collection hopper 2' through recycling duct 206' and back into the interior of the silo for recycling. Such recycling is preferably accomplished in the same manner in the embodiment of FIG. 1A. The recycling procedure is then preferably repeated until the material achieves an acceptable quality of blending.

Figure 7:
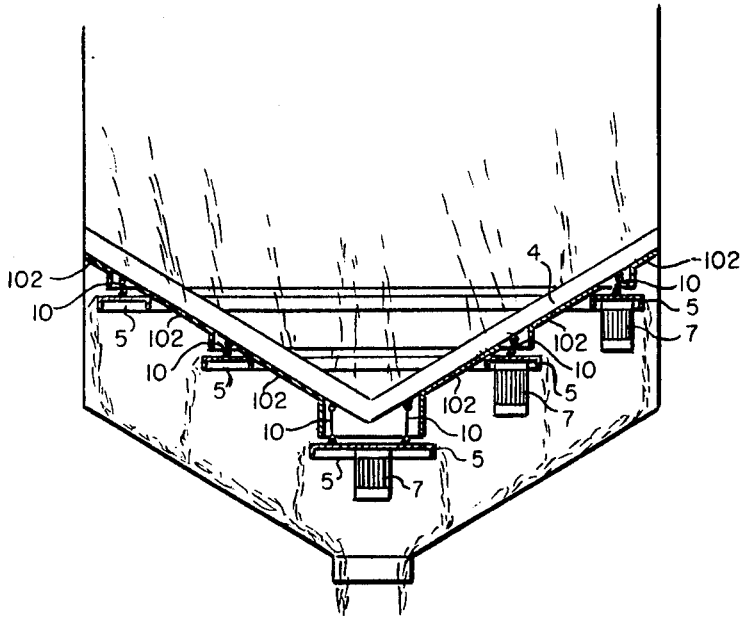
FIG. 7 is a partial schematic sectional view similar to FIG. 1A of another alternative embodiment of the blending bottom in accordance with the present invention.

Before describing the preferred blending procedure or method of the present invention, brief reference shall be made to FIGS. 7–13 which illustrate alternative arrangements for the blending bottom 204, 204' portion of the universal blending silo 200, 200' of the present invention. Thus, FIG. 7 illustrates an arrangement characterized by a smaller number of blending rings 5 than in the embodiment of FIGS. 1A or 2A with a frustum of a cone 102 preferably being attached between adjacent rings 5 to the conical supporting frame 4 in order to reduce the size of the slot in between the adjacent rings 5. In addition, as will be noted with reference to FIG. 7, the vibrators 7 are preferably positioned beneath the blending rings 5 as opposed to adjacent to the blending rings as illustrated in FIGS. 1A and 2A.

Figure 8:
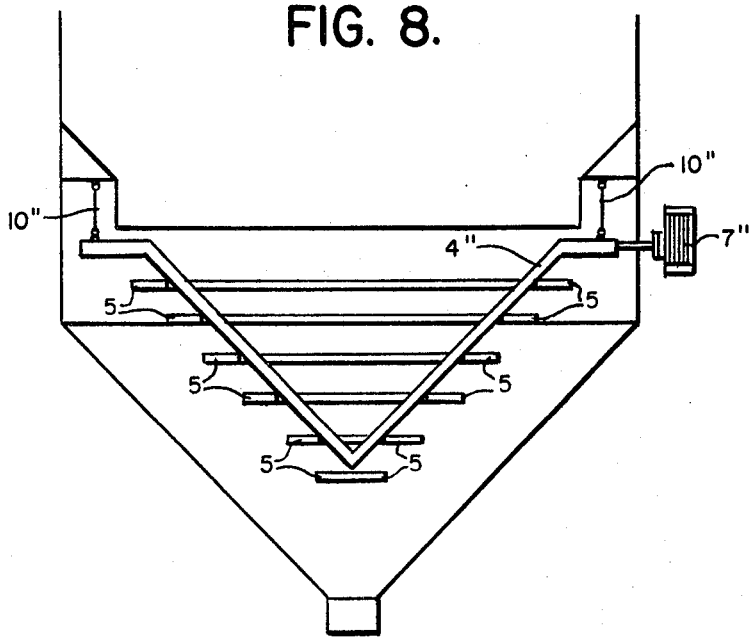
FIG. 8 is a partial schematic sectional view similar to FIG. 7 of still another alternative embodiment of the blending bottom portion of the present invention.

FIG. 8 illustrates an alternative embodiment in which the blending rings 5 are all fixedly connected to the conical supporting frame 4" with the supporting frame 4" being hingedly connected to the side walls of the silo by hinge connectors 10". The supporting frame 4" is driven by a common vibrator 7" as opposed to the arrangement illustrated in FIGS. 1A and 2A in which the vibrator 7, 7' drives the rings 5, 5' individually.

Figure 9:
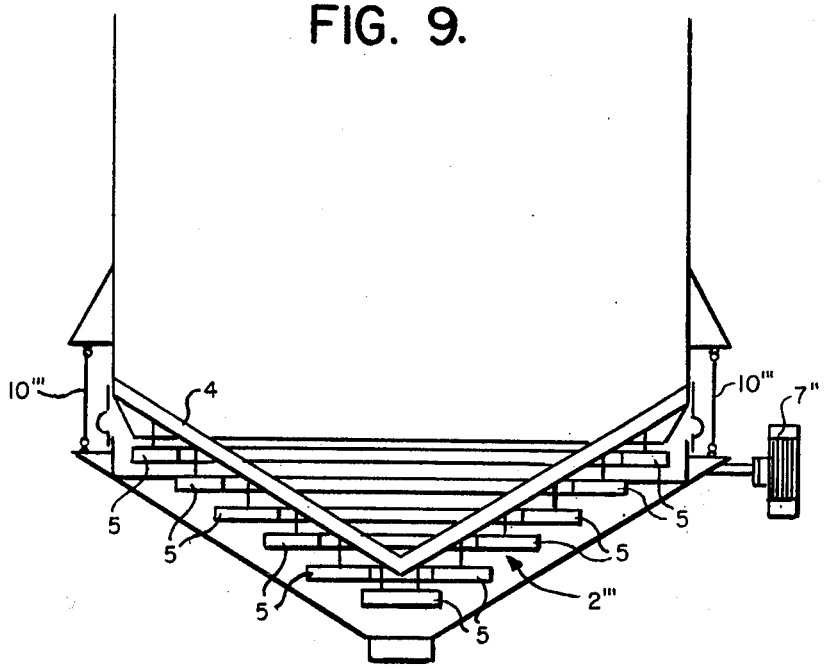
FIG. 9 is a partial schematic sectional view similar to FIG. 7 of yet another alternative embodiment of the blending bottom portion of the universal blending silo of the present invention.

In FIG. 9 an arrangement is illustrated in which a common vibrator 7" drives the collection hopper 2'" with the blending bottom being rigidly connected to the silo via hinge connectors 10'" and with the rings 5 being fixed to the support frame which is in turn fixed to the collection hopper 2'".

Figure 10:
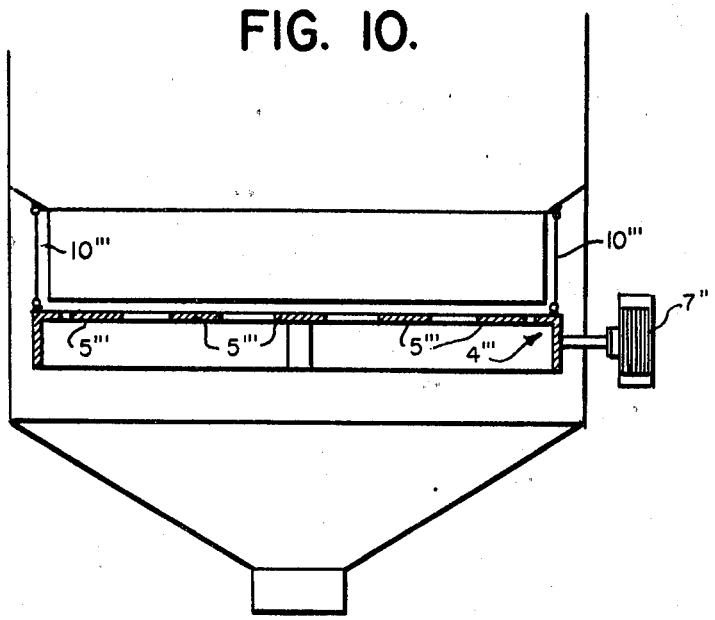
FIG. 10 is a partial schematic sectional view similar to FIG. 7 of still another alternative embodiment of the blending bottom portion of the universal blending silo of the present invention.

In the arrangement illustrated in FIG. 10, the blending rings 5'" are mounted in a common plane with the rings 5'" being mounted on a single frame 4'" which is driven by a common vibrator 7". A circular slot opening is provided between a pair of adjacent rings 5'".

Figure 11:
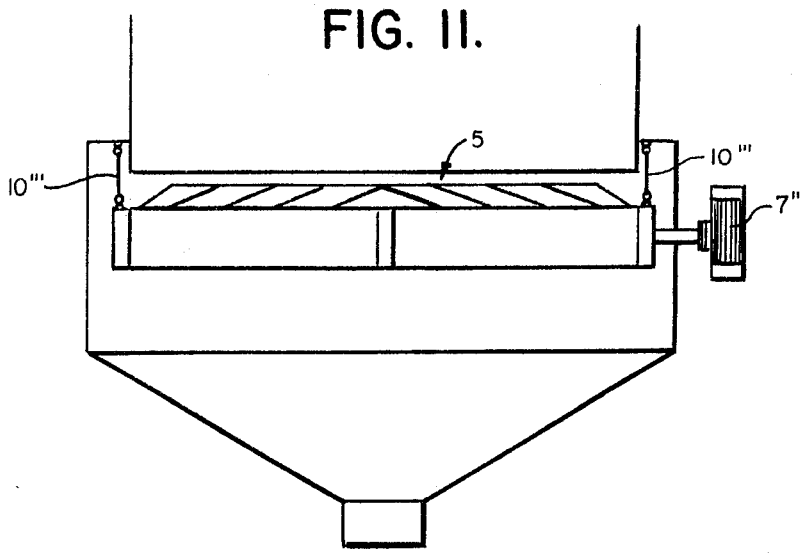
FIG. 11 is a partial schematic sectional view similar to FIG. 7 of yet another alternative embodiment of the blending bottom portion of the universal blending silo of the present invention.

Referring now to FIG. 11, an arrangement is illustrated in which the rings 5 have the form of a frustum of a cone and are mounted on a single frame driven by a common vibrator 7" hingedly connected via connectors 10'" to the silo.

Figure 12:
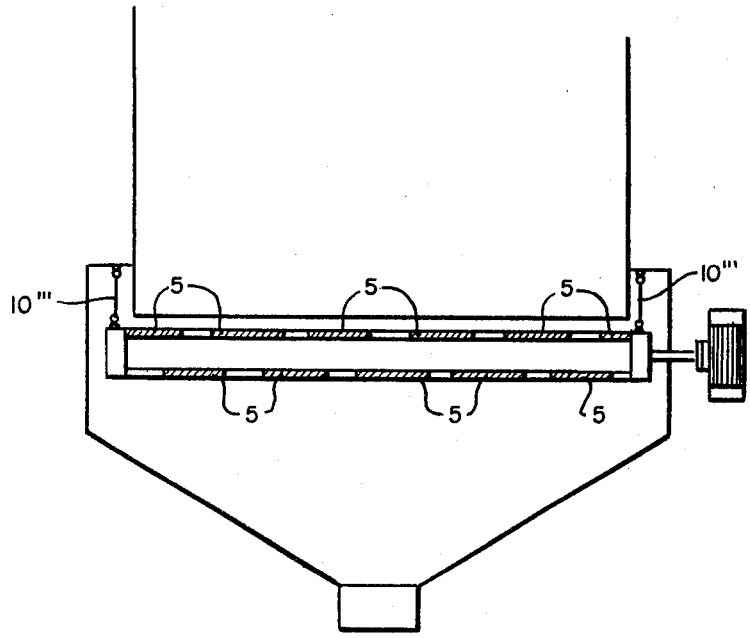
FIG. 12 is a partial schematic sectional view similar to FIG. 7 of still another alternative embodiment of the blending bottom portion of the universal blending silo of the present invention.

FIG. 12 illustrates an arrangement in which the blending bottom is comprised of two levels of rings 5 with the rings 5 in the lower level being positioned under the circular slots between the rings 5 in the upper level and with the frame being driven by a common vibrator 7" and being hingedly connected via hinge connectors 10'" to the silo. The distance between the rings 5 in the upper and lower levels can preferably be adjusted by an adjusting device, such as adjusting nuts 11.

Figure 21A:
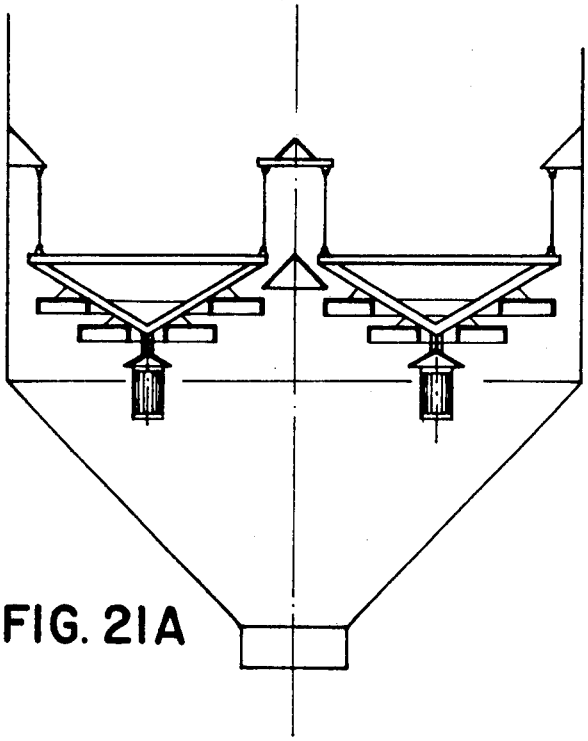
FIG. 21A is a partial schematic sectional view of the interior of the blending silo provided with a multiple blending bottom.
Figure 21B:
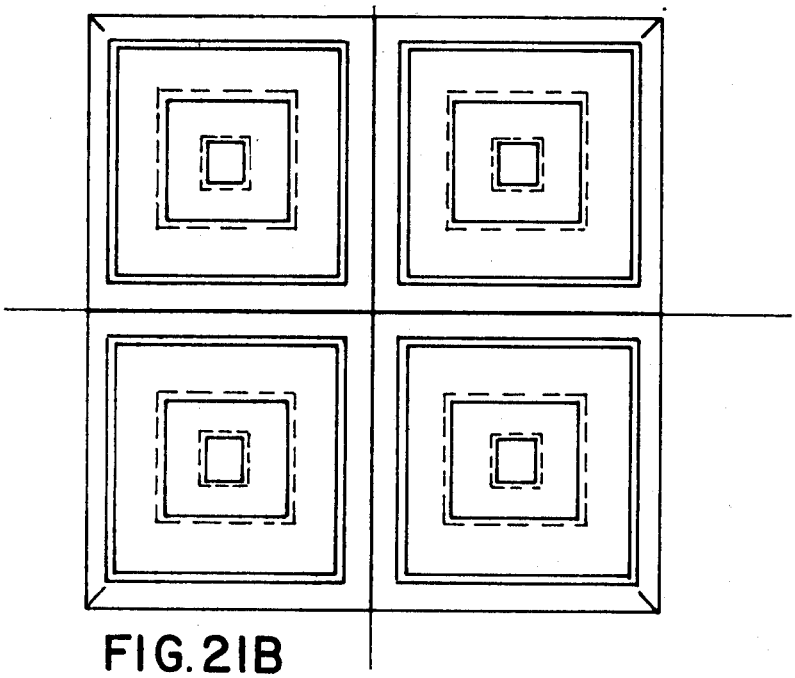
FIG. 21B is a cross-sectional view taken along line B—B in FIG. 21A.
Figure 22:
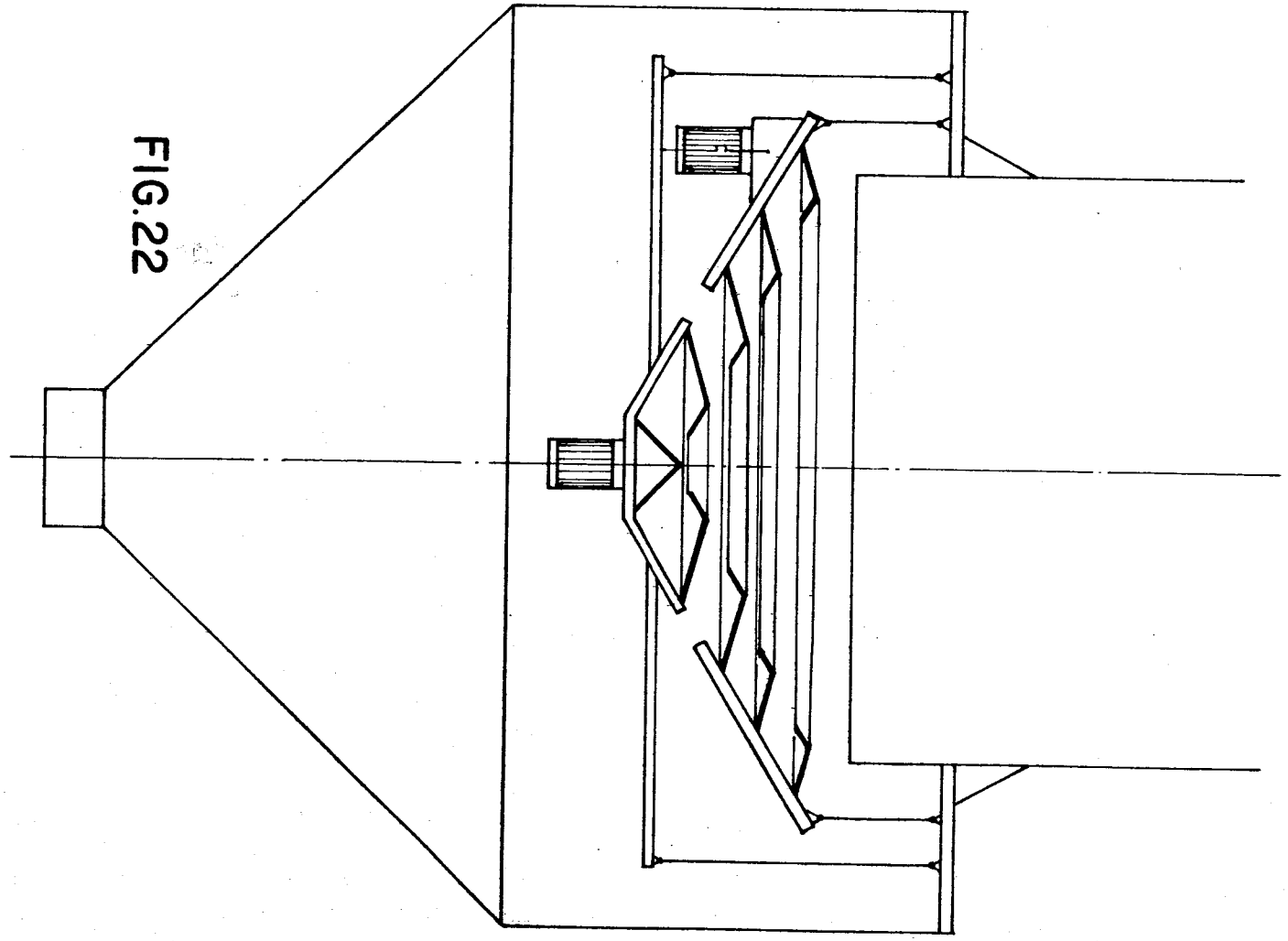
FIG. 22 is a partial schematic sectional view of the interior of blending silo where the rings are mounted on two or more vibrating frames.
Figure 23:
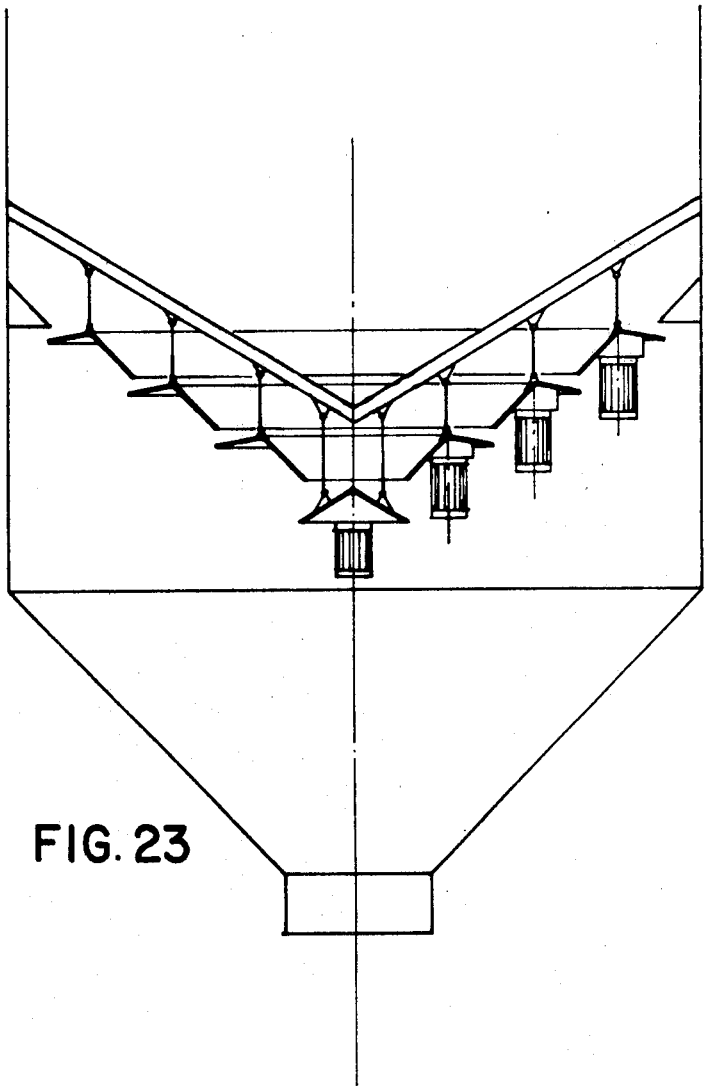
FIG. 23 shows an arrangement of the blending rings with a frustrum of a cone mounted on the rings.
Figure 24:
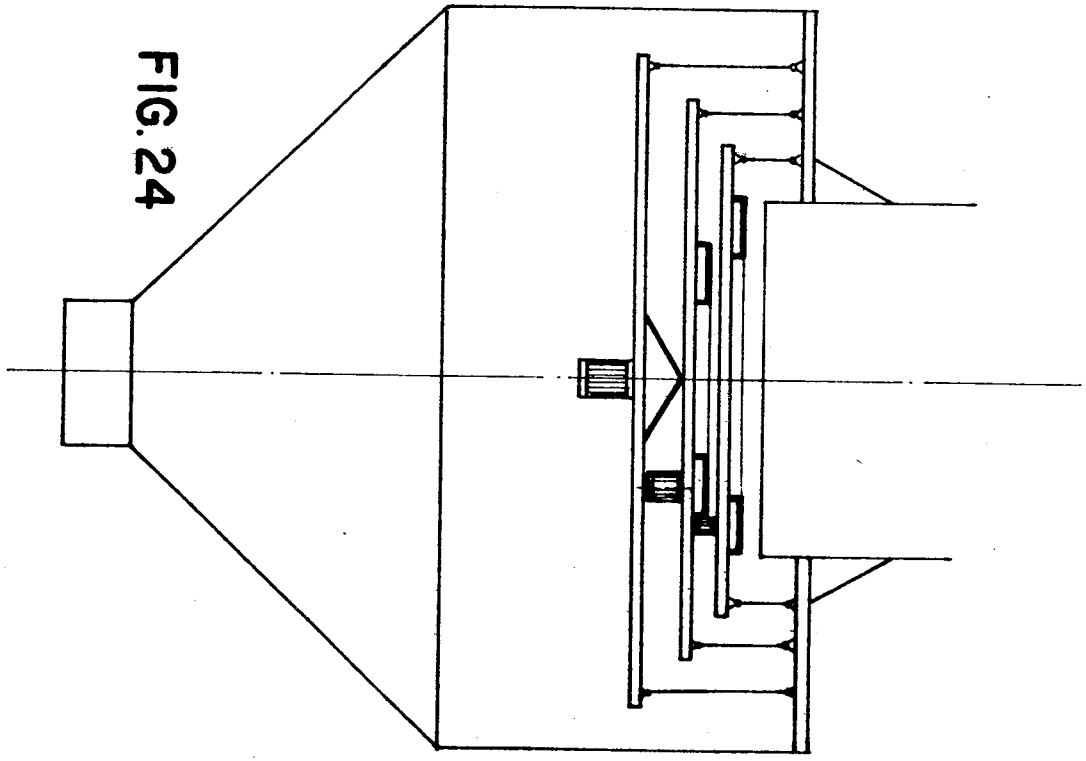
FIG. 24 shows an arrangement whereby each of the blending rings is connected to a separate frame which is hingingly connected to the silo.
Figure 25:
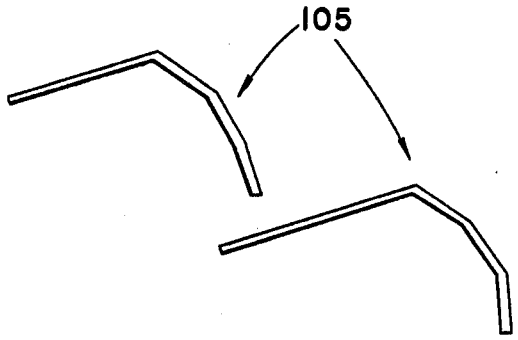
FIG. 25 shows a blending ring cross-section in the form of a frustum of a cone built up in sections.
Figure 26:
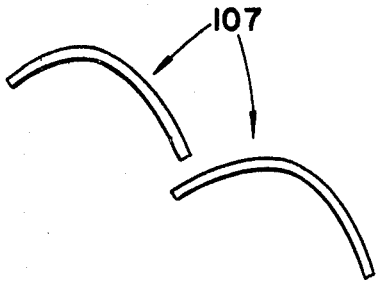
FIG. 26 shows a blending ring cross-section in the form of a convoluted section.

FIG. 21A is a sectional view of the interior of the blending silo provided with a multiple blending bottom. FIG. 21B is a cross-sectional view taken along line B—B in FIG. 21A. FIG. 22 shows the interior of the blending silo wherein the rings are mounted on two or more vibrating frames 4A and 4B. FIG. 23 illustrates an arrangement of the blending rings 5 with a frustrum of a cone 6 mounted on the rings, in order to increase the distance between two adjacent rings and to promote the flow of material above such rings. FIG. 24 illustrates an arrangement whereby each of the blending rings 5 is connected to a separate frame 6 which is hingedly connected 7 to the silo 8. FIG. 25 shows a blending ring cross-section in the form of a frustum of a cone 105 built up in sections. FIG. 26 shows a blending ring cross-section in the form of a convoluted section 107.

Figure 13:
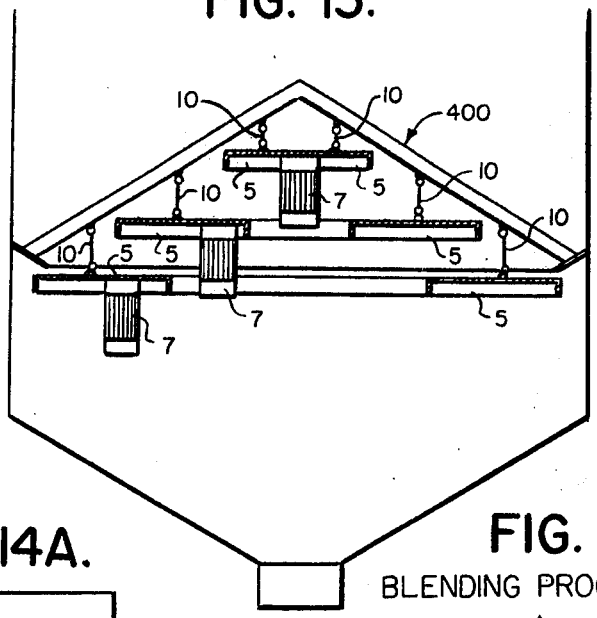
FIG. 13 is a partial schematic sectional view similar to FIG. 7 of yet another alternative embodiment of the blending bottom portion of the universal blending silo of the present invention.

Referring now to FIG. 13, the arrangement illustrated therein shows a blending bottom having a conical support frame 400 having its top or apex pointed upwards in the direction against the normal flow of material from the silo. The blending rings 5 are hingedly connected to the conical support frame 400 by means of hinge connectors 10 with the blending rings 5 being individually driven by vibrators 7. In addition, preferably the uppermost blending rings 5 have a smaller diameter than the lower blending rings 5. Thus, in the arrangement illustrated in FIG. 13, discharge of the material takes place due to the fact that the natural angle of repose of the material is disturbed or decreased during vibrations, such as illustrated in FIGS. 14A and 14B.

Now describing the preferred blending method or procedure of the present invention. It should be noted that the choice of blending silo configuration depends upon the distribution of material properties within the silo. Thus, if material is fed into the silo in discrete batches then layering may occur. In such an instance, each layer may have a different composition or different properties that should be leveled by blending in a procedure which is called layer blending. Alternatively, the particle size distribution of the granular material may be such that segregation occurs during filling or recycling with the coarser components of the material moving toward the silo walls. In such an instance, cylindrical segments of different composition and properties develop and are eventually leveled by blending in a procedure termed segment blending. In addition, combinations of layer and segment blending may be desired such as illustrated in FIGS. 18A–18D. Thus, segregation and layering and the number of different components are determining factors in selection of the desired blending procedure to be employed in accordance with the method of the present invention.

Referring initially to FIGS. 16A and 16B, segment blending of a multi-component system is illustrated with A and B representing materials of different characteristics such as composition and/or properties. In such an instance, adequate blending may be achieved by only using the blending bottom configuration of the present invention and adjusting it in such a manner that a uniform vertical velocity is reached over the entire cross-section of the silo as diagrammatically illustrated in FIG. 16B.

Figures 17, 17A, 17B, 17C, 17D:
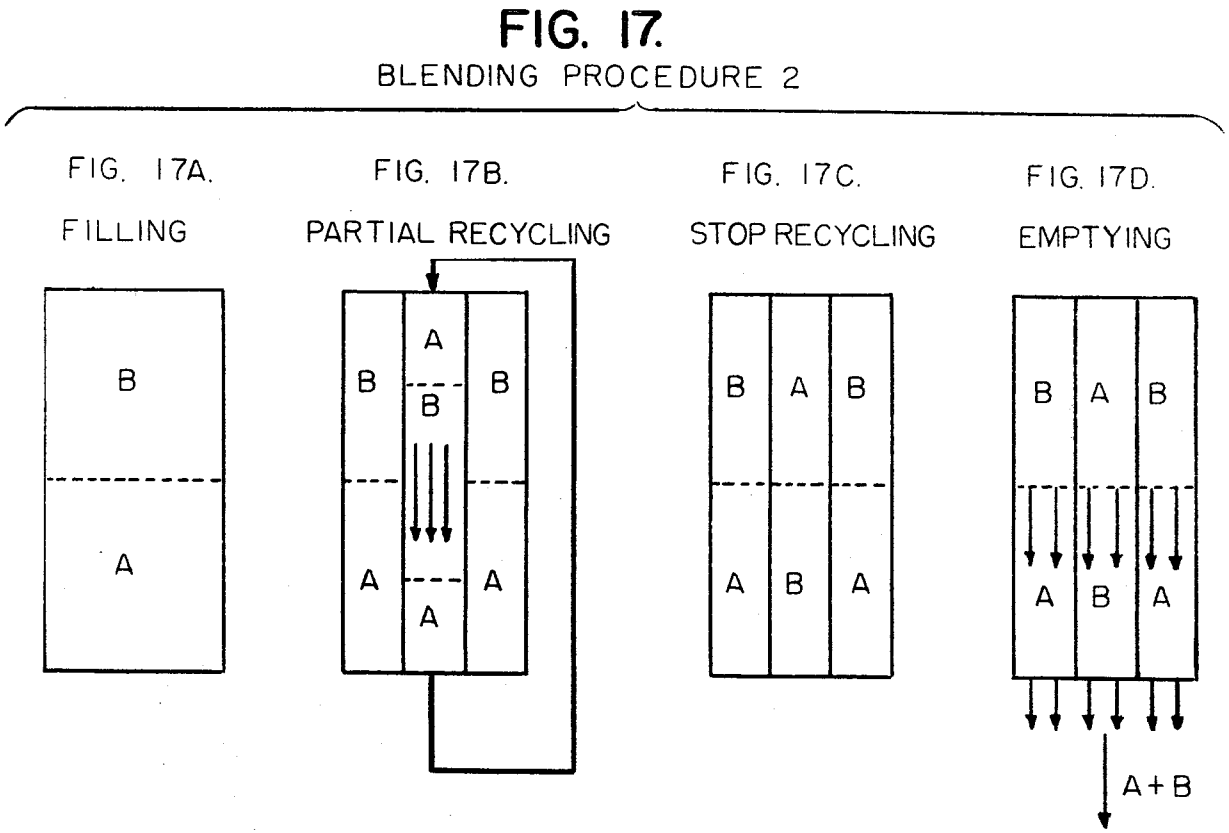
FIGS. 17A–17D are diagrammatic illustrations representative of another blending procedure in accordance with the method of the present invention.
Figure 18:
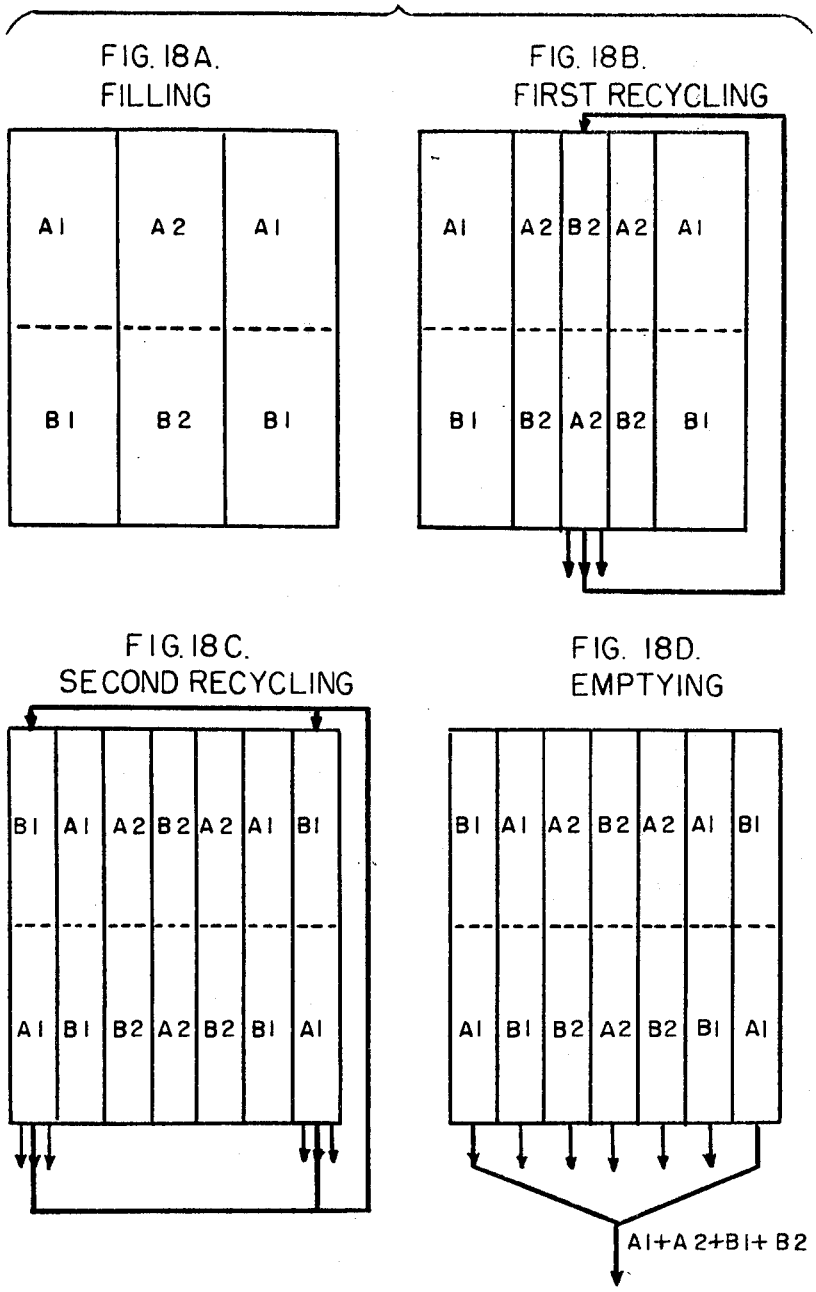
FIGS. 18A–18D are diagrammatic illustrations of another blending procedure in accordance with the method of the present invention.
Figure 19:
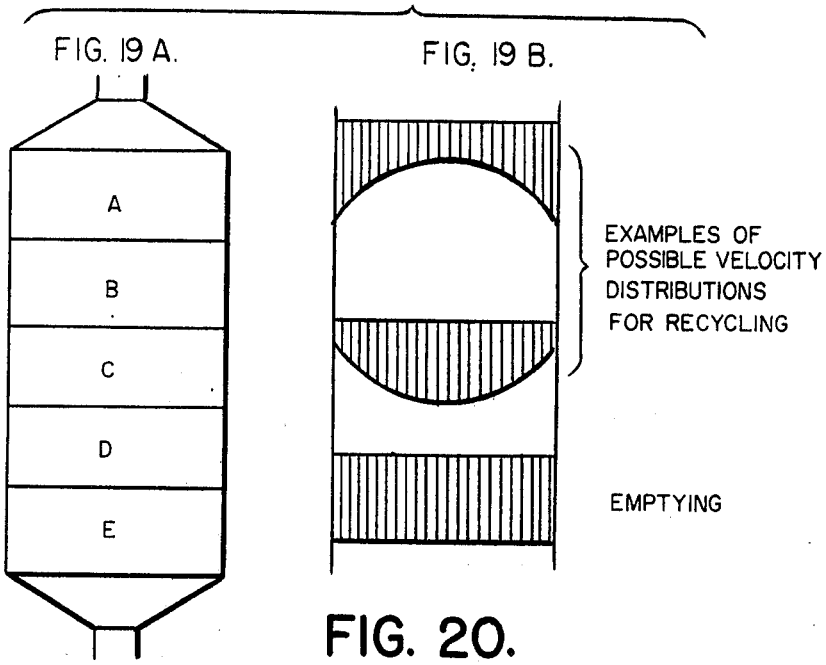
FIGS. 19A and 19B are diagrammatic illustrations of still another blending procedure in accordance with the method of the present invention.

Referring now to FIGS. 17A–17D, layer blending of a two layer system comprising layers A, B with each layer having a different composition and/or different properties is shown. In accordance with the method of the present invention, by activating a plurality of centrally located blending rings 5 a partial vertical column of material above the activated part of the blending bottom whose cross-sectional area is less than the interior cross-sectional area of the silo is lowered or displaced over a vertical distance of the thickness of one layer as illustrated in FIGS. 17B and 17C. In order to obtain the checkered blending pattern illustrated in FIG. 17D, a quantity of material must be initially moved from the lower section, layer A in the example of FIGS. 17A–17D, into the upper section, layer B in the example of FIGS. 17A–17D. This is accomplished in accordance with the method of the present invention by discharging the partial vertical column of material of the lower section as illustrated in FIG. 17B without substantially disturbing a vertically adjacent partial vertical column of material, and, thereafter, recycling the discharged portion of the partial vertical column of material back into the empty space that has developed in the upper section as a result of this area being vacated by the vertically displaced partial vertical column upper section as illustrated in FIGS. 17B and 17C. Thus, the initial lower section of this partial vertical column is discharged into the collection hopper and recycled to occupy the space vacated by the vertically displaced initial upper section. The batch is then alternated across the diameter of the silo and represents in each cross-section of the silo the required ratio of blending with a representative mixture thus being provided in every cross-section. This representative mixture is illustrated by FIG. 17C. This representative mixture is then uniformly discharged across the entire cross-sectional area of the silo as illustrated in FIG. 17D in the same manner as illustrated in FIG. 16D.

Referring now to FIGS. 18A–18D, the blending system of the present invention can also be used for a combination of layer and segment blending in accordance with the method of the present invention. Thus, as previously mentioned, A and B represent layers of different composition. However, in the example of FIGS. 18A–18D, each layer preferably consists of segregated zones of different particle sizes which have been marked by the representative numerals 1 and 2 after the corresponding layer designation A or B to indicate a differentiation in particle size. The aforementioned checkered blending pattern which was achieved in the example of FIGS. 17A–17D is again obtained in the example of FIGS. 18A–18D; however, it is obtained through two recycling steps as opposed to the one recycling step illustrated in the example of FIGS. 17A–17D. In the first step illustrated in FIGS. 18A and 18B, the central column which is represented in FIG. 18A by layers A2 and B2, is recycled in a manner previously described with reference to FIGS. 17A–17D; that is a partial vertical column having an initial lower section and an initial upper section is discharged with the lower section being discharged into the collection hopper and recycled to occupy the space vacated by the vertically displaced upper section. The results of this first recycling are diagrammatically illustrated in FIG. 18B. The second recycling step is illustrated in FIG. 18C and preferably occurs solely with respect to the outer vertical column adjacently flanking the central column and is represented by layers A1 and B1. Thus, as was previously described with respect to FIGS. 18B and 17A–17C, a partial vertical column in each of the outer columns, having a cross-sectional area less than the interior cross-sectional area of the silo is discharged with the lower section being discharged into the collection hopper and recycled to occupy the space vacated by the vertically displaced upper section in each of the outer columns, such as diagrammatically illustrated in FIG. 18C. Again, a representative mixture in every cross-section is provided and this representative mixture is preferably uniformly discharged over the entire interior cross-sectional area of the silo as illustrated in FIG. 18D.

Referring now to FIGS. 19A and 19B, layer blending of a multi-component system in accordance with a preferred method of the present invention is illustrated. It should be noted that layer blending of multi-component systems in the prior art normally requires a large number of recycling steps. However, by forcing the sinking velocity of the discharge material in the silo into an appropriate velocity profile in accordance with the present invention, such as by adjustment of the discharge rate of the blending rings 5, the relative position of the layers will shift causing an initial blending. Such a typical velocity profile is illustrated in FIG. 19B by way example, illustrating examples of possible velocity distribution for recycling.

If desired, prior to accomplishing this step the blending procedure previously described with reference to FIGS. 17A–17D can be accomplished to accelerate the blending process by initially providing a representative mixture in every cross-section.

Figure 20:
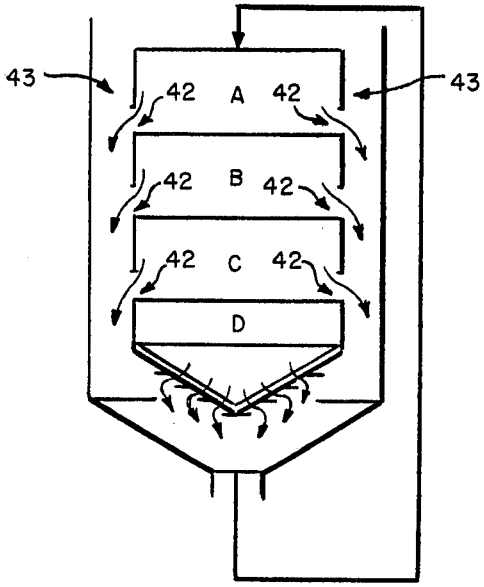
FIG. 20 is a diagrammatic illustration of yet another blending procedure in accordance with the method of the present invention.

Referring now to FIG. 20, as well as to FIGS. 2A and 2B, layer blending of a multi-component system in accordance with a method of the present invention is illustrated. Thus, in order to reduce the number of recyclings required to accomplish the requisite layer blending, preferably the various layers A–D in the example of FIG. 20, are substantially simultaneously independently discharged into the collection hopper 2' by discharge of these various layers through the blending ducts 43 with the inlets 42 to the blending ducts 43 being disposed at appropriate vertical locations therein adjacent to the respective layers A–D as diagrammatically illustrated in FIG. 20. In addition, the layered material is also preferably simultaneously collectively discharged into the collection hopper 2' through the blending bottom 204' via blending rings 5' and vibrators 7'. The discharged material coming from the blending ducts 43 and from the blending bottom 204' is preferably collected in the collection hopper 2' and is recycled via recycling duct 206'. Subsequent discharge and recycling is preferably continued until an adequate blending has been obtained. This procedure is preferably useful for tall blending silos, that is silos which are relatively high in comparison to the diameter of the silo.

It should be noted that in place of the arrangement illustrated in FIG. 7 in which the frustum of a cone 102 is attached between adjacent rings 5 to the conical supporting frame 4, conical portion 102 could be attached directly to the ring 5, with this arrangement being hingedly connected to the supporting frame 4 in order to reduce the size of the slot in between the adjacent rings 5.

It should also be noted that in the instance of free flowing materials, vertically spaced rings 5 should preferably overlap in the direction of material flow between adjacent pairs of rings 5, such as illustrated in FIGS. 5A and 5B and FIGS. 14A and 14B. However, if cohesive materials are being blended, then the vertically spaced adjacent rings 5 need not be overlapped.

Thus, by utilizing the preferred method and system of the present invention, universal blending in a common silo may be efficiently obtained wherein a common blending silo may handle blending for all size particles from fine to coarse with a minimal amount of recycling.

As used throughout the specification and claims, the term "discharging of the partial vertical column" is meant to refer to its displacement.

What is claimed is:

1. A universal blending system for blending the material contents of a silo, said silo having interior side walls and a blending bottom, said system blending bottom comprising a fixed support frame connected to said silo side walls, a collection hopper, a plurality of spaced apart blending rings positioned adjacent each other in an array above said collection hopper, said rings being hingedly connected to said frame in said array, a generally circular slot opening being formed between an adjacent pair of rings in said array for enabling controllable flow of said material between said adjacent rings into said collection hopper, and vibrator means operatively connected in said system for vibrating said rings and said frame relative to each other at a predetermined amplitude and frequency for disturbing the steady state condition of said material between said adjacent pair of rings for providing said controllable flow, the intensity of said vibratory movement of each of said rings around the symmetric axis of said rings controlling the rate of flow of said material through each of said circular slot openings.

2. A system in accordance with claim 1 wherein said adjacent pair of rings are positioned above each other in said array.

3. A system in accordance with claim 2 wherein said adjacent pair of rings comprises an upper ring and a lower ring of different diameters.

4. A system in accordance with claim 3 wherein said upper ring diameter is larger than said lower ring diameter.

5. A system in accordance with claim 3 wherein said lower ring diameter is larger than said upper ring diameter.

6. A system in accordance with claim 2 wherein each of said rings further comprises a frustum of a cone for reducing said slot.

7. A system in accordance with claim 2 further comprising means for controllably adjusting the spacing between said pair of adjacent rings.

8. A system in accordance with claim 2 further comprising a frustum of a cone attached to said support frame between adjacent rings for reducing the size of said slot between said adjacent rings.

9. A system in accordance with claim 2 wherein said adjacent pair of rings positioned above each other are further positioned so as to overlap each other in the direction of said material flow between said adjacent pair of rings.

10. A system in accordance with claim 1 wherein said vibrator means is connected to each of said rings.

11. A system in accordance with claim 1 wherein said vibrator means is connected to said frame.

12. A system in accordance with claim 1 further comprising means for controllably adjusting the spacing between said pair of adjacent rings.

13. A system in accordance with claim 1 wherein said rings are circular.

14. A system in accordance with claim 1 wherein said rings are rectangular.

15. A system in accordance with claim 1 wherein said rings are polygonal.

16. A system in accordance with claim 1 wherein the form of said rings is elliptic.

17. A system in accordance with claim 15 wherein the form of the cross-section of said rings is convoluted.

18. A system in accordance with claim 1 wherein all of said rings are mounted on one vibrating frame.

19. A system in accordance with claim 1 wherein said rings are mounted on more than one vibrating frame.

20. A system in accordance with claim 1 wherein each of said rings is individually mounted on a vibrating frame.

21. A system in accordance with claim 1 wherein said rings are mounted in one plane on vibrating frame means, with a slot opening being formed between an adjacent pair of said rings.

22. A system in accordance with claim 21 wherein each of said ring cross-sections comprises a frustum of a cone.

23. A system in accordance with claim 1 wherein said rings are positioned in one or more levels in said array.

24. A system in accordance with claim 1 wherein the height between a pair of adjacent rings comprises a frustum of a cone with a slot opening being formed between said frustum of a cone and said ring.

25. A system in accordance with claim 24 wherein said ring having a cross-section which comprises a frustum of a cone built up in sections from various angles from the horizontal.

26. A system in accordance with claim 1 wherein said silo comprises a plurality of said blending bottoms.

27. A system in accordance with claim 1, further comprising a plurality of ducts having a plurality of inlets located at various heights along said silo wall.

28. A system in accordance with claim 27, wherein said inlets are adjustable.

* * * * *